United States Patent [19]

Miller

[11] Patent Number: 4,463,239

[45] Date of Patent: Jul. 31, 1984

[54] ROTATING SLOT ANTENNA ARRANGEMENT FOR MICROWAVE OVEN

[75] Inventor: Matthew S. Miller, Louisville, Ky.

[73] Assignee: General Electric Company, Louisville, Ky.

[21] Appl. No.: 447,290

[22] Filed: Dec. 6, 1982

[51] Int. Cl.[3] ..... H05B 6/72

[52] U.S. Cl. ..... 219/10.55 F

[58] Field of Search ..... 219/10.55 F, 10.55 A, 219/10.55 R, 10.55 E

[56] References Cited

U.S. PATENT DOCUMENTS

| | | | |
|---|---|---|---|
| 2,704,802 | 3/1955 | Blass et al. | 219/10.55 |
| 3,436,507 | 4/1969 | Puschner | 219/10.55 |
| 3,746,823 | 7/1973 | Whiteley | 219/10.55 |
| 3,810,248 | 5/1974 | Risman et al. | 219/10.55 |
| 3,872,276 | 3/1975 | Corcoran et al. | 219/10.55 |
| 4,019,009 | 4/1977 | Kusunoki et al. | 219/10.55 F |
| 4,028,521 | 6/1977 | Uyeda et al. | 219/10.55 F |
| 4,284,868 | 8/1981 | Simpson | 219/10.55 F |
| 4,316,069 | 2/1982 | Fitzmayer | 219/10.55 F |
| 4,327,266 | 4/1982 | Austin et al. | 219/10.55 F |
| 4,335,290 | 6/1982 | Teich | 219/10.55 F |
| 4,343,976 | 8/1982 | Nasretdin et al. | 219/10.55 F |
| 4,424,430 | 1/1984 | Almgren et al. | 219/10.55 F |
| 4,430,538 | 2/1984 | Suzuki et al. | 219/10.55 F |
| 4,430,539 | 2/1984 | Suzuki | 219/10.55 F |

FOREIGN PATENT DOCUMENTS

| | | |
|---|---|---|
| 4640978 | 3/1967 | Japan . |
| 4640980 | 3/1967 | Japan . |

*Primary Examiner*—Roy N. Envall, Jr.

*Assistant Examiner*—Philip H. Leung

*Attorney, Agent, or Firm*—H. Neil Houser; Radford M. Reams

[57] ABSTRACT

An excitation system for a microwave cooking appliance which employs a low profile rotating disk to enhance time-averaged uniformity of energy distribution within the resonant cooking cavity. A rectangular waveguide couples energy from the magnetron to the cooking cavity. A circular opening is formed in a common wall between the waveguide and the cooking cavity, which opening is essentially blocked by a rotatable metallic disk overlapping the opening on the cavity side of the wall. An elongated radiating slot is formed on the disk for coupling energy from the waveguide to the cooking cavity extending generally transverse to the radius of the disk. The axis of rotation of the disk is longitudinally spaced an odd integral multiple of quarter guide wavelengths from the short circuit termination of the waveguide, and the longitudinal axis of the radiating slot is radially spaced approximately one quarter guide wavelength from the axis of rotation of the disk, thereby orienting the slot alternately as a series slot at a maximum wall current point and a shunt slot at a maximum field point with each quarter revolution of the disk. During each complete rotation of the disk, the slot passes through four maximum energy coupling positions with less optimum coupling positions interspersed therebetween, thereby enhancing time-averaged energy distribution uniformity in the cavity by periodically varying the radiation intensity of the slot and its position in the cavity during each rotation of the disk.

12 Claims, 5 Drawing Figures

FIG. 4
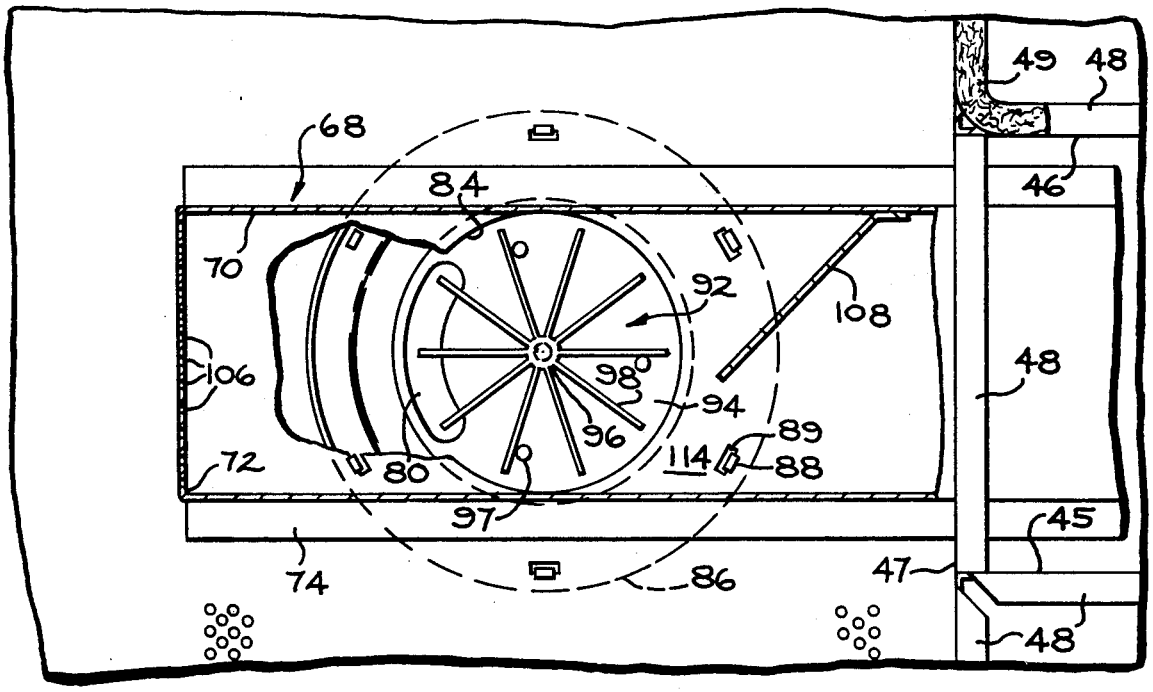
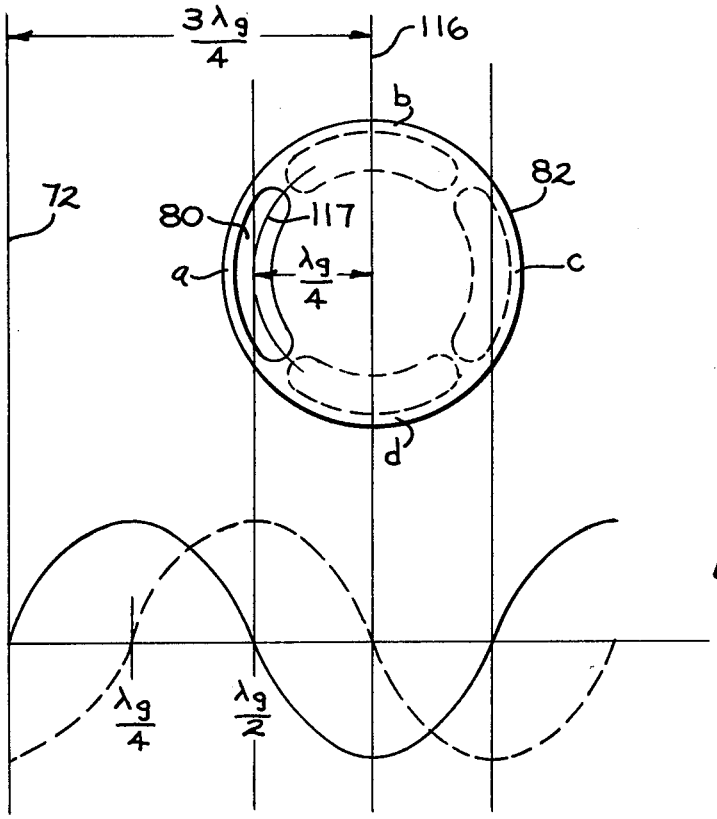
FIG. 5

ROTATING SLOT ANTENNA ARRANGEMENT FOR MICROWAVE OVEN

BACKGROUND OF THE INVENTION

The present invention relates to a microwave cooking oven and more specifically to an improved excitation system for such an oven which enhances the time-averaged uniformity of energy distribution within the cooking cavity.

A continuing problem in the design of microwave cooking ovens is to eliminate hot and cold spots in the cooking cavity resulting from the non-uniform spatial distribution of energy in the cavity. Such non-uniform energy distribution is often explained to be the result of the establishment of electromagnetic standing wave patterns, known as "modes," within the cooking cavity. When such standing wave patterns exist in the cavity, the intensity of the electric and magnetic fields vary greatly with position. The particular mode patterns which may be established in the cavity are dependent upon many variables including the frequency of the microwave energy used to excite the cavity and the dimensions of the cavity.

A number of different approaches to enhance uniform energy distribution by altering the standing wave patterns in the cavity have been tried. One common approach involves the use of a so-called "mode stirrer" which typically resembles a fan with metal blades. This stirrer is normally located near the point where energy is coupled into the cooking cavity, such as in the cooking cavity itself or in the waveguide, coupling energy from the magentron to the cavity near an exit port of the waveguide. In any case, the mode stirring approach is an attempt to randomize energy reflections in the cavity by introducing time varying scattering of the microwave energy by reflection from the stirrer blades as the microwave energy enters the cavity. While mode stirring has been found to provide some improvement in energy distribution uniformity, side-to-side and front-to-back field strength variations are not entirely eliminated.

Another approach has involved the use of a rotating antenna in the cavity. Prior art relating to such use of rotating antenna may be found in U.S. Pat. No. 4,028,521 to Uyeda et al; 4,284,868 to Simpson; and 4,316,069 to Fitzmayer, for example. Even though rotating antennas tend to improve uniformity of energy distribution in the cavity, typical antenna configurations tend to leave cold spots. For centrally mounted antenna, such cold spots tend to occur near the center of rotation of the antenna. Rotating antenna arrangements also have a significant assembly disadvantage in that energy coupling efficiency and impedance matching are extremely sensitive to assembly tolerances. For example, coupling efficiency is extremely sensitive to the depth of penetration of the antenna probe into the waveguide; also, antenna impedance is extremely sensitive to the spacing between the antenna arms and the ground plane; i.e., the adjacent cavity wall. In addition, antennas generally protrude into the cooking cavity, reducing the usable cavity space.

The use of radiating slots is also known in the art. U.S. Pat. Nos. 4,019,009 to Kusunoki et al; U.S. Pat. No. 2,804,802 to Blass et al; and U.S. Pat. No. 3,810,248 to Risman et al provide examples of stationary radiating slots arranged beneath the food load to be heated. U.S. Pat. No. 3,210,511 to Smith provides single diametrically opposed slots on the top and bottom walls of the cooking cavity oriented at right angles to each other to produce circularly polarized radiation in the cavity.

U.S. Pat. No. 4,327,266 to Austin et al combines a rotating antenna and slot to provide a coaxially fed bilaterally symmetrical rotating plate antenna disposed near the bottom wall of the cavity and having radiating wings at its periphery and a substantially tangential radiating slot closely adjacent its axis of rotation, which purportedly results in uniform microwave heating of food items in the cavity due to a balance between aperture radiation and wing radiation. This antenna configuration appears to protrude into the cavity to an undesirable extent.

U.S. Pat. No. 3,746,823 seeks to provide improved energy distribution uniformity by providing a rotating disk having formed therein several elongated radiating apertures sequentially oriented transverse to the longitudinal waveguide axis, each aperture being oriented and positioned such that when transverse to the longitudinal waveguide axis the apertures appear electrically at integral multiples of half-wave points from the magnetron to achieve maximum energy transfer through the transverse apertures, while allowing only a minimum amount of energy to be transferred into the cavity when the apertures are aligned parallel to the longitudinal waveguide axis, thus appearing to produce a radiation system permitting maximum power transfer to the cavity. However, such an arrangement is believed to be limited as to time-averaged uniformity of energy distribution in the cavity.

While each of the approaches mentioned herein appears to provide some improvement in the attempt to overcome the energy non-uniformity problem in microwave ovens, a need remains for a relatively simple, efficient low profile energization system which provides good uniformity of energy distribution in the cooking cavity without extending obtrusively into the cavity so as to maximize the space available in the cavity to receive items to be heated.

It is therefore an object of the present invention to provide a relatively simple, efficient excitation system for a microwave oven which enhances the time-averaged uniformity of energy distribution within the cavity employing an extremely low profile radiating member which projects only minimally into the cooking cavity.

SUMMARY OF THE INVENTION

In accordance with the present invention, a microwave oven having a cooking cavity of the resonant type comprising a generally rectangular enclosure defined by conductive walls is provided with an excitation system which employs a low profile rotating radiating member to enhance time-averaged uniformity of energy distribution within the cavity. A rectangular waveguide extending generally centrally along the upper wall of the cavity couples energy from the magnetron to the cooking cavity. A circular opening is formed in a common wall between the waveguide and the cooking cavity, which opening is essentially blocked by a rotatably mounted metallic circular disk which overlaps the opening on the cavity side of the wall. A radiating aperture is formed on the disk for coupling energy from the waveguide to the cooking cavity. The aperture is in the form of an elongated slot extending generally transverse to the radius of the disk. The axis of rotation of the disk is longitudinally spaced an odd integral multiple of quarter guide wavelengths from the short circuit termination of the waveguide, and the longitudinal axis of the radiating slot is radially spaced approximately one quarter guide wavelength from the axis of rotation of the disk. As the disk rotates, the slot is alternately oriented as a series slot and a shunt slot with each quarter revolution of the disk. This location of the disk relative to the waveguide termination and the radial spacing of the slot relative to the axis of rotation of the disk assures that the slot will be at a maximum current point when oriented as a series slot and at a maximum field point when oriented as a shunt slot. Thus, during each complete rotation of the disk the slot passes through four maximum energy coupling positions with less optimum coupling positions interspersed therebetween. Thus, by periodically varying the radiation intensity of the slot and its position in the cavity during each rotation of the disk, the time-averaged energy distribution in the cavity is significantly enhanced.

BRIEF DESCRIPTION OF THE DRAWINGS

While the novel functions of the invention are set forth with particularity in the appended claims, the invention both as to organization and content will be better understood and appreciated from the following detailed description taken in conjunction with the drawings in which:

FIG. 4 is a partial top view of the oven of FIG. 1 with portions removed to show structural details of the waveguide and slotted disk mounting and driving arrangement; and FIG. 5 is a schematic view of the disk showing the various maximum coupling positions assumed by the radiating slot during each rotation of the disk in relation to the standing wave field and current patterns in the waveguide.

DETAILED DESCRIPTION

Figure 1:
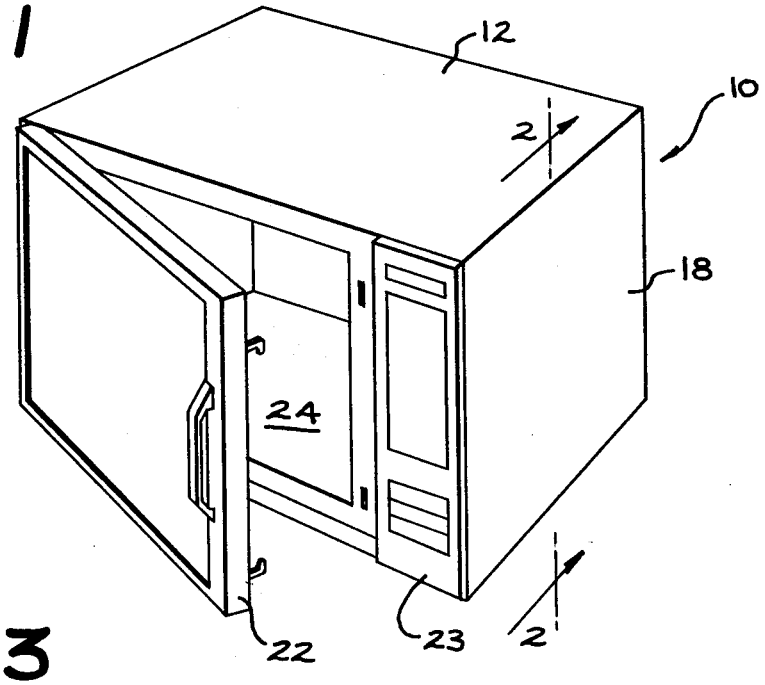
FIG. 1 is a perspective view of a microwave oven illustratively embodying the excitation system of the invention.
Figure 3:
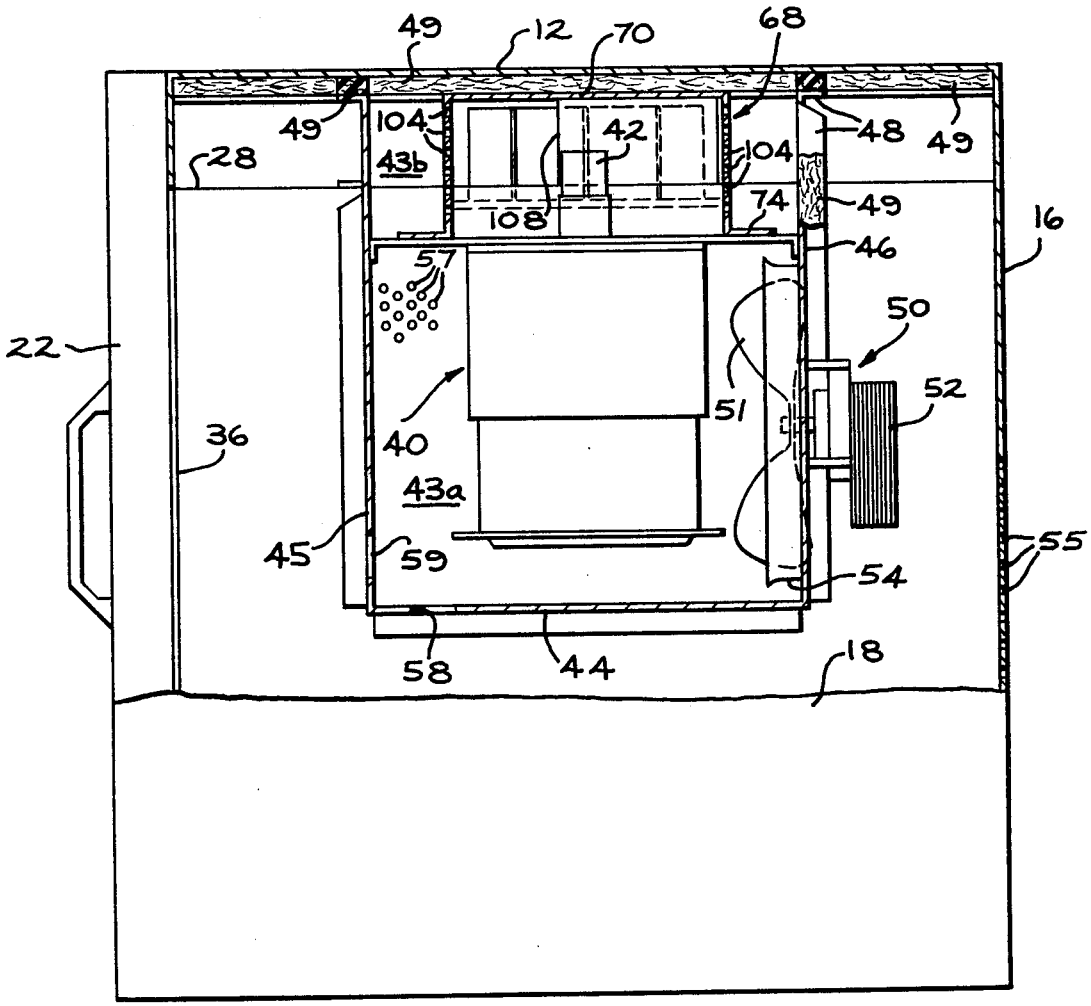
FIG. 3 is a schematic side view, partially in section, of the microwave oven of FIG. 1 with portions removed to illustrate structural details.
Figure 2:
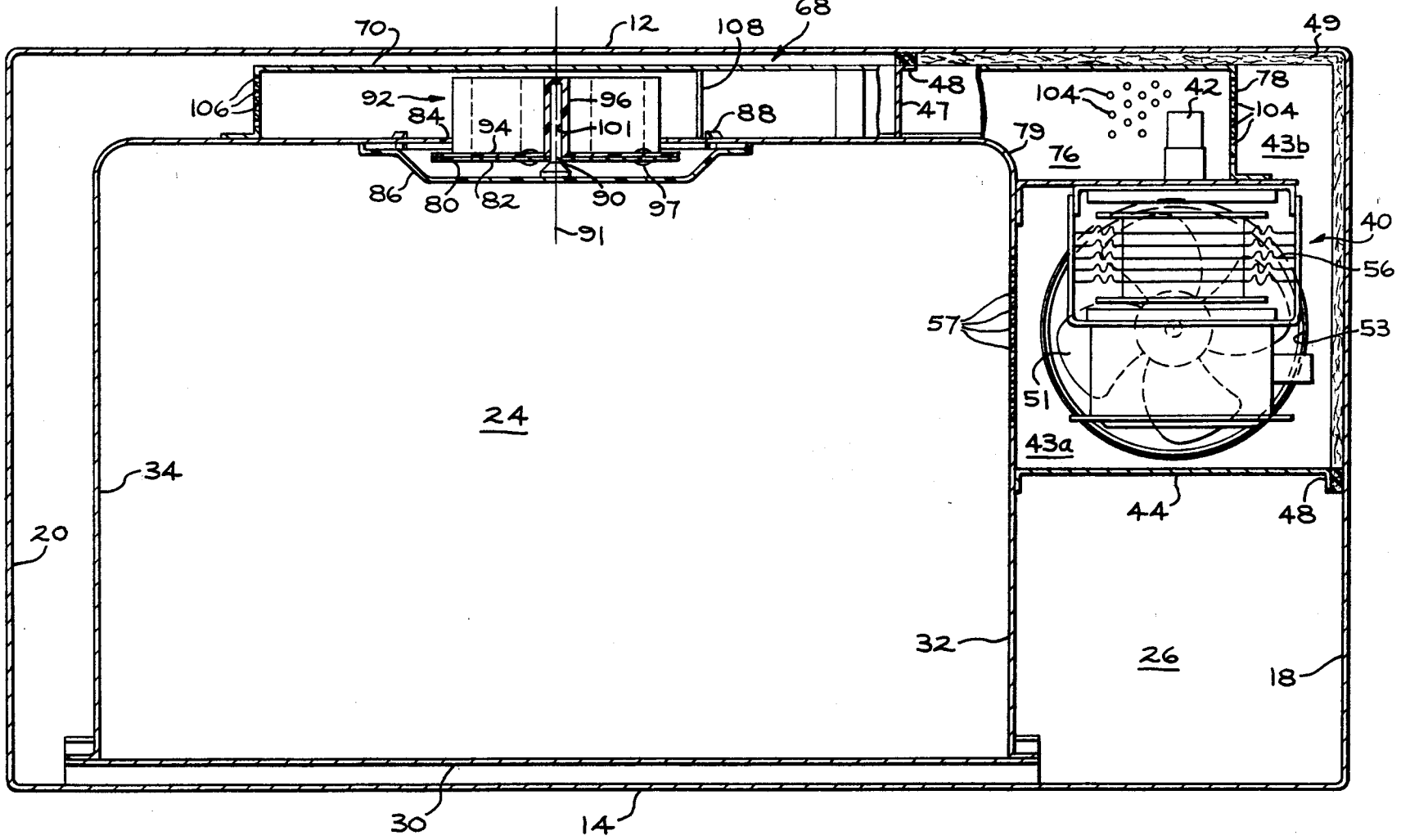
FIG. 2 is a front schematic sectional view of the microwave oven of FIG. 1 taken along lines 2—2.

Referring now to FIGS. 1–4, there is shown a microwave oven designated generally 10. The outer cabinet comprises six cabinet walls including upper and lower walls 12 and 14, and rear wall 16, two side walls 18 and 20 and a front wall partly formed by hingedly supported door 22 and partly by control panel 23. The space inside the outer cabinet is divided generally into a cooking cavity 24 and a controls compartment 26. The cooking cavity includes top wall 28, a bottom wall 30, side walls 32 and 34, the rear cavity wall being cabinet wall 16 and the front cavity wall being defined by the inner face 36 of door 22. Nominal dimensions of cavity 24 are 16 inches wide by 8 inches high by 11 inches deep.

Controls compartment 26 has mounted therein a magnetron 40 which is adapted to produce microwave energy having a center frequency of approximately 2450 MHz at output probe 42 thereof when coupled to a suitable source of power (not shown) such as the 120 volt AC power supply typically provided at domestic wall receptacles. A cooling air plenum having a lower portion **43*a* substantially enclosing magnetron 40 and an upper portion 43*b* substantially enclosing a portion of the feed waveguide is formed by a bottom wall 44 extending beneath magnetron 40 between cavity side wall 32 and cabinet side wall 18, opposing side walls 45 and 46 extending upwardly from bottom wall to upper cabinet wall 12 and an end wall 47 extending front to back between upper cavity wall 28 and upper cabinet wall 12. Each of plenum walls 44, 45, 46 and 47 is secured along the adjacent cavity wall edge to the adjacent cavity wall by suitable means such as by welding. A flange 48 is formed along the opposite edges of these plenum walls adjacent the cabinet wall. A strip 49 of gasket material is sandwiched between the flanged edge 48 and the cabinet walls to provide an airtight seal therebetween. A blower for magnetron cooling designated generally 50, comprising a fan 51 driven by electric motor 52, is mounted in a circular opening 53 in rear partition 46. An annular shroud 54 surrounds fan 51. Blower 50 draws in cooling air from outside the outer cabinet through perforations 55 in rear cabinet wall 16. The air enters plenum portion 43*a* where it passes over the magnetron cooling fins 56. A portion of this air enters the cooking cavity 24 through ventilation holes 57 in cavity side wall 32. The balance enters upper plenum 43*b* to provide air flow for rotating the slotted disk radiator of the present invention in a manner to be described in greater detail hereinafter. Openings 58 and 59 formed in partitions 44 and 45, respectively, are provided to prevent the buildup of back pressure in plenum 43**.

The front facing opening of controls compartment 26 is enclosed by control panel 23. It will be understood that numerous other components are required in a complete microwave oven but for clarity of illustration and description only those elements believed essential for a proper understanding of the present invention are shown and described. Such other elements may all be conventional and, as such, are well known to those skilled in the art.

The structure of the excitation system in accordance with the present invention as illustratively embodied in microwave oven 10 will now be described. The source of microwave energy is magnetron 40. Microwave energy from magnetron output probe 42 of magnetron 40 is coupled to the cooking cavity 24 via rectangular feed waveguide 68 which extends generally centrally along the upper cavity wall 28. Waveguide 68 is of generally rectangular cross section being formed by member 70 of generally U-shaped cross section and a portion of top cavity wall 28 which forms a common wall for waveguide 68 and cavity 24. Conductive end wall 72 provides a short circuit termination for waveguide 68 remote from magnetron 40. Member 70 is suitably flanged as at 74 for attachment to top cavity wall 28 by suitable means such as welding. Waveguide 68 is dimensioned to support a $TE_{10}$ propagating mode. Specifically, the width (the dimensions running front to rear of the cavity) is more than one-half but less than one guide wavelength, and the height is less than one-half waveguide wavelength. As used herein, the guide wavelength refers to the wavelength of microwave energy propagating within the waveguide. In the illustrative embodiment, the height of waveguide 68 is nominally 0.75 inches and the width is nominally 3.66 inches.

A microwave energy launching area 76 for energy radiated from magnetron probe 42 is provided by an extension of waveguide member 70 which encloses probe 42 on top and sides. Support flange 77 encloses the bottom of the launch area. Conductive end wall 78 is spaced approximately ¾ inch from probe 42 to provide a launch area short circuit waveguide termination. The spacing is in accordance with magnetron manufacturer recommendation for proper power output and operating characteristics. Launching area 76 is of the same width as waveguide 68 but of height on the order of 2 inches, with the open end facing curved step 79 formed at the intersection of cavity side wall 32 and top wall 28. Curved step 79 (radius of curvature nominally 0.64") provides the desired sending impedance for satisfactory impedance matching.

Microwave energy from waveguide 68 is radiated into cooking cavity 24 by a radiating aperture in the form of elongated slot 80 formed in a circular disk 82 extending generally transversely to the radius of the disk 82. Disk 82 extends within cavity 24 and is mounted for rotation in a plane parallel to and in close proximity to upper cavity wall 28. A circular opening 84 to accommodate disk 82 is formed in that portion of upper cavity wall 28 in common with waveguide 68 having a diameter slightly less than the diameter of disk 82. A plastic cover 86 for supporting disk 82 adjacent opening 84 and enclosing opening 84 and disk 82, attaches to upper cavity wall 28 by resilient tabs 88 which project through small slots 89 in wall 28, annularly distributed about opening 84 for this purpose. A plastic shaft member 90 is formed integrally with cover 86 projecting upwardly from cover 86 to rotatably support disk 82, the longitudinal axis 91 of shaft 90 defining the axis of rotation for disk 82. For reasons to be explained in greater detail hereinafter, cover 86 is mounted to top wall 28 with shaft 90 centered relative to cooking cavity 24 and at a point located approximately 3 quarter guide wavelengths from waveguide end wall 72.

Disk 82 is carried by an integrally molded plastic member designated generally 92, comprising a circular support and spacer disk 94 which is co-extensive with disk 82, a vertically extending cylindrical central portion 96, and a plurality of vanes 90 projecting radially from the central portion 96. Disk 82 is secured to support disk 94 by three polypropylene snap buttons 97. An aperture is formed in support disk 94 co-extensive with slot 80 in disk 82.

In addition to supporting disk 82, disk 94 also acts as an insulating spacer separating disk 82 from cavity wall 28. Since the radially outermost portion of metallic disk 82 overlaps that portion of waveguide wall 28 surrounding the circular opening 84 formed herein, capcitive coupling exists between the disk edge and the adjacent waveguide wall. The dielectric spacer provided by support disk 94 increases the capacitance between wall 28 and disk 82 so as to minimize the resultant impedance. In addition, the high voltage breakdown in the region of overlap is increased so as to avoid arcing between disk 82 and cavity wall 28. The thickness of the spacer employed in the illustrative embodiment is approximately 0.060 inches.

While the dielectric spacer in the illustrative embodiment is a full disk which completely covers metallic disk 82, an annular ring of dielectric material which covers the disk 82 in the region of overlap between disk 82 and wall 28 could be used as well.

The vertically extending cylindrical portion 96 formed at the center of support disk 94 has formed therein a downwardly facing blind bore 101 which receives shaft 90 to rotatably support plastic member 92 and disk 82 on shaft 90. Vertical spacing between disk 82 and wall 28 is on the order of 0.090 inches, 0.060 being spacer thickness and 0.030 being air.

Means for rotating disk 82 comprises radially extending vanes 98. Vanes 98 rotate about shaft 90 in response to air moving down waveguide 68. To this end, vanes 98 project through opening 84 in wall 28 into the interior of waveguide 68. Air for rotating disk 82 enters waveguide 68 through openings 104 formed for that purpose in end wall 78 and in the waveguide side walls in the vicinity of probe 42. This air travels down waveguide 68 to impinge on vanes 98 and then exits waveguide 68 through exit holes 106 formed in end wall 72. A diverting wall 108 is formed in waveguide 68 of microwave pervious material. Diverting wall 108 extends the full height of waveguide 68 and projects at an angle from the rear side of waveguide 68, stopping short of the front wall, leaving a gap 114 therebetween. Air forced down waveguide 68 by blower 50 is thereby channeled through gap 114 to impinge on the frontwardly extending vanes 98 to cause rotation of the plastic member 92 and disk 82 carried thereon in a clockwise direction, as viewed in FIG. 4. While the illustrative embodiment described herein employs an air driven disk arrangement, it will be apparent that other means for rotating the disk, such as a motor driven arrangement, could be similarly employed.

Cover 86, shaft 90 and plastic member 92 are preferably made of a plastic material having high heat tolerance and low dielectric loss characteristics. A material particularly suitable for this purpose is the synthetic flouride resin sold under the trademark of Teflon, which in addition to the desired heat resistance and low dielectric losses also provides low frictional losses during rotation of the disk.

In the discussion to follow, the rotating disk and slot configuration is described in more specific geometric and dimensional detail with particular reference to FIGS. 4 and 5. It is to be emphasized, however, that the specific dimensions of the illustrative embodiment herein described do not necessarily represent limits of useful values or limitations on the full scope of the invention but, rather, are intended to provide direction to those skilled in the art. Similarly, the accompanying explanation of the present understanding of the theory of operation of this invention is provided for the benefit of workers in the art and should not be viewed as limiting the invention described herein to a precise theory of operation.

In the illustrative embodiment, disk 82 is formed of sheet metal 0.032 inches thick and having a diameter of 4.0 inches. Aperture 80 is a substantially arcuate elongated slot having a width-to-length ratio less than 0.2. This slot length relationship provides a slot which is the dual of a wire line dipole antenna, thus having a sinusoidal electric field distribution along the slot length. In the illustrative embodiment, arcuate slot length is approximately 2.5 inches, and slot width is approximately 0.375 inches.

The orientation and radial spacing of slot 80 relative to the axis of rotation 116 of the disk 82 and longitudinal spacing of the axis of rotation 116 relative to the short circuit termination at end wall 72 of waveguide 68 are critical for efficient energy coupling. In the description to follow, the spacing dimensions are given in terms of guide wavelengths, $\lambda g$. The term guide wavelength is used herein to specify the wavelength of the standing wave in the waveguide which is a well known function of the free space wavelength and waveguide dimensions. In accordance with the invention, the radial distance between the axis of rotation 116 of disk 82 and the longitudinal center line 118 of slot 80 is approximately one-quarter guide wavelength (λg/4). The longitudinal distance from the short circuit termination provided by end wall 72 of waveguide 68 and the axis of rotation 116 of disk 82 is an odd integral multiple of quarter guide wavelengths. For the frequency and waveguide structure employed in the illustrative embodiment of FIGS. 1–4, the guide wavelength is approximately 6.4 inches; the radial dimension between axis of rotation 116 and slot center line 117 is approximately 1.6 inches; and the distance from end wall 72 to the axis of rotation 116 is approximately 4.8 inches corresponding to three quarter guide wavelengths.

Orientation of elongated slot 80 substantially transverse to a radial line extending from the axis of rotation 116 through the longitudinal midpoint of the slot is important in that for efficient energy coupling the slot should be oriented substantially transverse to the longitudinal axis of the waveguide at distances from the short circuit termination which are integral multiples of half guide wavelengths and be oriented substantially parallel to the longitudinal axis of the waveguide at distances from the short circuit termination which are odd multiples of quarter guide wavelengths. For the arcuate slot of the illustrative embodiment or alternatively for a straight elongate slot, these conditions will be satisfied by spacing of the axis of rotation of the disk an odd multiple of quarter guide wavelengths from the waveguide short circuit termination and by orienting the slot to extend substantially transverse to a radial line extending from the axis of rotation to the longitudinal midpoint of the slot and spacing the slot such that the length of the radial line is approximately one quarter guide wavelength.

The significance of the slot orientation and spacing dimensions will now be described with reference particularly to FIG. 5. As is well known, microwave energy propagates in short circuit terminated rectangular waveguides such as waveguide 68 with a standing wave characterized by an electric field which varies in intensity and direction sinusoidally along the length of the waveguide, with zero field points at the short circuit termination and half-guide wavelength intervals therefrom, and maximum field points occurring at intervals along the length of the waveguide which are odd multiples of quarter guide wavelengths from the short circuit termination. Wall currents established in waveguide walls also vary sinusoidally along the length of the waveguide but 90° out of phase with the electric field in the waveguide. Thus, maximum wall current points are present at the short circuit termination and at half guide wavelength intervals therefrom.

In accordance with established slotted waveguide theory, slots transverse to the direction of propagation, i.e., the longitudinal axis of the waveguide, can be characterized as series slots, and slots parallel to the direction of propagation can be characterized as shunt slots. Maximum coupling, that is, maximum power transfer for series slots, is obtained by centering such slots at the minimum field, maximum current points, i.e., at distances which are integral multiples of half guide wavelengths from the short circuit termination. Conversely, maximum coupling for shunt slots is achieved by positioning the slot in shunt orientation at the maximum field, minimum wall current point, i.e., at distances which are odd multiples of quarter guide wavelengths, and offset laterally from the waveguide longitudinal center line.

It will be apparent from FIG. 5 that by positioning the disk 82 and orienting slot 80 in accordance with the invention, that is, with the axis of rotation of the disk positioned an odd number of quarter guide wavelengths from the short circuit termination of the waveguide, and with the slot radially positioned a quarter guide wavelength from the axis of rotation, during each complete rotation of the disk the slot passes through four maximum coupling positions. The waveforms illustrated in FIG. 5 qualitatively represent the electric field and wall current magnitudes for the standing wave supported in the waveguide as a function of distance (expressed in guide wavelengths) from the short circuit waveguide termination 72, with field intensity represented in full and current represented in phantom.

During each rotation of the disk, the slot sequentially passes through the four positions designated a, b, c and d, positions b, c and d being illustrated in phantom. In positions a and c, slot 80 is oriented as a series slot generally transverse to the longitudinal waveguide axis and centered at a minimum electric field, maximum current point along the waveguide for maximum coupling. When at positions b and d, slot 80 is oriented as a shunt slot generally parallel to the longitudinal waveguide axis and laterally offset from the center line of the waveguide and centered longitudinally relative to the waveguide at a maximum electric field, minimum current point for maximum shunt slot coupling. Thus, with each quarter revolution of the disk, the slot is alternately oriented relative to the waveguide as a series slot and a shunt slot with the spacing of slots relative to the short circuit termination being such that maximum coupling of energy from the waveguide to the cooking cavity via the slot is accomplished. When passing between these four positions, the slot functions as a hybrid series shunt slot with varying coupling efficiency. Consequently, the radiation from the slot varies in intensity during each rotation with four positions a, b, c and d of relative maximum intensity angularly spaced apart by 90°.

Thus, by this arrangement, efficient coupling of energy from the waveguide 68 to the cooking cavity 24 is achieved in a manner which enhances time-averaged energy distribution in the cooking cavity.

While in the illustrative embodiment herein to be described an arcuate slot is used, it is to be understood that a straight elongated slot similarly oriented could also be used. The arcuate slot is used in the illustrative embodiment in order to obtain satisfactory slot length within the size constraints imposed by the maximum width of the waveguide which limits the maximum diameter of circular opening 84 in wall 28, which in turn limits the maximum straight slot length which can be provided for a straight slot centered λg/4 from the axis of rotation without extending beyond opening 84 in wall 28. However, it is to be understood that where spacing permits, an elongated straight slot in disk 80 could be satisfactorily employed, provided that its longitudinal axis or center line is oriented to be substantially perpendicular to a radial line extending from the axis of rotation of disk 82 and intersecting the midpoint of the longitudinal center line of the slot. This insures that as the disk rotates the slot is substantially transverse to the longitudinal axis of the waveguide at integral multiples of half guide wavelengths and substantially parallel to the longitudinal axis of the waveguide at odd multiples of quarter guide wavelengths.

While a specific embodiment of the invention has been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. An excitation system for a microwave oven cooking cavity having electrically conductive walls, said excitation system enhancing time-averaged uniformity of energy distribution and comprising:

a rectangular feed waveguide extending along the outer surface of one of the cooking cavity walls, one wall of said waveguide being common with at least a portion of said one wall of the cooking cavity, said one wall having formed therein a circular opening;

a microwave energy generator coupled to said waveguide to establish a mode therein;

said waveguide having a short circuit termination remote from said generator beyond said circular opening;

a circular metallic disk of greater diameter than said opening mounted for rotation in a plane parallel to and in close proximity to said one wall and having an axis of rotation coaxially aligned with said opening so as to substantially block said opening; and means for rotating said disk; said disk having formed therein an elongated radiating slot, said slot being oriented relative to said disk such that as said disk rotates said slot is alternately oriented to radiate as a series slot and a shunt slot with each quarter revolution of said disk; the spacing of said slot relative to said axis of rotation and said axis of rotation relative to said waveguide short circuit termination being such that maximum coupling of energy from said waveguide to the cooking cavity via said slot is provided at each of the series slot and shunt slot locations; thereby enabling said radiating slot to pass through four maximum energy coupling positions during each rotation of said disk to provide enhanced time-averaged energy distribution in the cooking cavity.

2. The excitation system of claim 1 wherein said slot is oriented substantially transverse to a radial line extending from said axis of rotation and intersecting its longitudinal midpoint, said axis of rotation of said disk is longitudinally displaced from said short circuit termination by an odd number of guide quarter wavelengths, and the length of said radial line is approximately one guide quarter wavelength.

3. The excitation system of claim 2 wherein the ratio of said slot width to said slot length is less than 0.2.

4. The excitation system in accordance with claim 3 further comprising a dielectric spacer between said metallic disk and said one wall to increase the capacitive coupling therebetween.

5. An excitation system for a microwave oven cooking cavity having electrically conductive walls, said excitation system enhancing time-averaged uniformity of energy distribution and comprising:

a rectangular feed waveguide extending along the outer surface of one of the cooking cavity walls, one wall of said waveguide being common with at least a portion of said one wall of the cooking cavity, said one wall having formed therein a circular opening;

a microwave energy generator coupled to said waveguide to establish a mode therein;

said waveguide having a short circuit termination remote from said generator;

a circular metallic disk of greater diameter than said opening mounted for rotation in a plane parallel to and in close proximity to said one wall and having an axis of rotation coaxially aligned with said opening so as to substantially block said opening; and means for rotating said disk;

said disk having formed therein an arcuate radiating slot having a length substantially greater than its width, said slot being positioned relative to the axis of rotation of said disk and said short circuit termination of said waveguide such that radiation from said slot varies in intensity during each rotation with four positions of relative maximum intensity being angularly spaced apart by 90°.

6. The excitation system of claim 5 wherein said slot is oriented substantially transverse to a radial line extending from said axis of rotation, said axis of rotation of said disk is longitudinally displaced from said short circuit termination by an odd number of guide quarter wavelengths, and the longitudinal center line of said radiating slot is radially displaced from said axis of rotation by approximately one guide quarter wavelength.

7. The excitation system of claim 6 wherein the ratio of said slot width to said slot length is less than 0.2.

8. The excitation system in accordance with claim 7 further comprising a dielectric spacer between said metallic disk and said one wall to increase the capacitive coupling therebetween.

9. An excitation system for a microwave oven cooking cavity having electrically conductive walls, said excitation system enhancing time-averaged uniformity of energy distribution and comprising:

a rectangular feed waveguide extending along the outer surface of one of the cooking cavity walls, one wall of said waveguide being common with at least a portion of said one wall of the cooking cavity, said one wall having formed therein a circular opening;

a microwave energy generator coupled to said waveguide to establish a mode therein;

said waveguide having a short circuit termination remote from said generator beyond said circular opening;

a circular metallic disk of greater diameter than said opening, mounted for rotation in a plane parallel to and in close proximity to said one wall and having an axis of rotation coaxially aligned with said opening so as to substantially block said opening; and means for rotating said disk;

said disk having formed therein an elongated radiating slot having a longitudinal center line which is substantially perpendicular to a radial line extending from the axis of rotation of said disk to the midpoint of said longitudinal center line, the length of said radial line being approximately one-quarter guide wavelength; said axis of rotation being longitudinally displaced from said waveguide short circuit termination by an odd number of guide quarter wavelengths;

thereby enabling said radiating slot to pass through four maximum energy coupling positions during each rotation of said disk.

10. The excitation system in accordance with claim 9 wherein said slot is alternately aligned relative to said waveguide means for energization as a series slot and a shunt slot with each quarter revolution of said disk.

11. The excitation system of claim 10 wherein the ratio of said slot width to said slot length is less than 0.2.

12. The excitation system in accordance with claim 11 further comprising a dielectric spacer between said metallic disk and said one wall to increase the capacitive coupling therebetween.

* * * * *